United States Patent [19]

Schier

[11] 4,318,353

[45] Mar. 9, 1982

[54] TABLE WITH FOLDING LEGS

[76] Inventor: Robert W. Schier, P.O. Box 407, Union, Ill. 60180

[21] Appl. No.: 129,130

[22] Filed: Mar. 10, 1980

[51] Int. Cl.[3] ..... A47B 3/00

[52] U.S. Cl. ..... 108/132; 108/130

[58] Field of Search ..... 108/132, 131, 133, 125, 108/130, 129

[56] References Cited

U.S. PATENT DOCUMENTS

| | | | |
|---|---|---|---|
| 790,893 | 5/1905 | Heilbron | 108/132 |
| 1,177,639 | 4/1916 | Lessord | 108/131 |
| 2,374,670 | 5/1945 | Duke | 108/133 X |
| 2,969,249 | 1/1961 | Fox | 108/131 X |
| 3,093,095 | 6/1963 | Howe et al. | 108/131 |
| 3,945,328 | 3/1976 | Hendrickson et al. | 108/132 |

*Primary Examiner*—Francis K. Zugel

*Attorney, Agent, or Firm*—Richard L. Johnston

[57] ABSTRACT

A table with folding legs is provided in which the legs are hingedly connected through leg spans to the underside of the top which also contains a pair of opposing aprons extending downwardly and affixed to the underside of the top, said aprons extending longitudinally at right angles to but spaced at their ends from the leg spans, and spreader members hingedly connected at one end to an opposite end of said aprons and slidingly connected at the other end to the leg spans so that the spreader members move inwardly when the leg spans are folded and outwardly in alignment with their respective aprons when the legs are upright and the leg spans are perpendicular to the underside of the table top. Means for locking the spreader members in place when the table is erected are also provided.

7 Claims, 5 Drawing Figures

FIG. 1
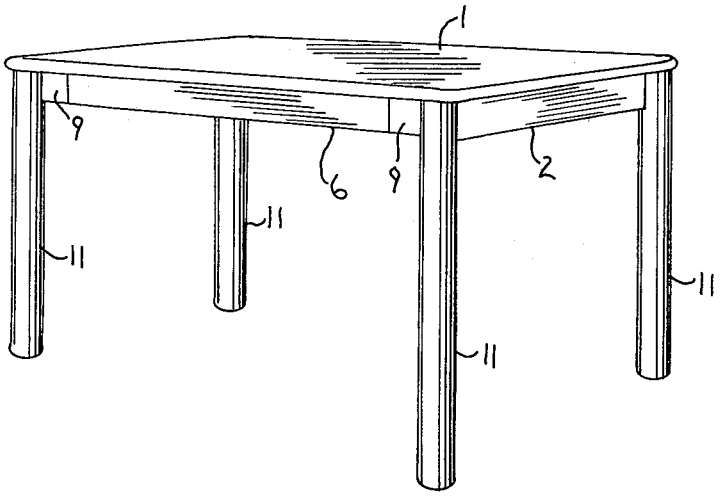
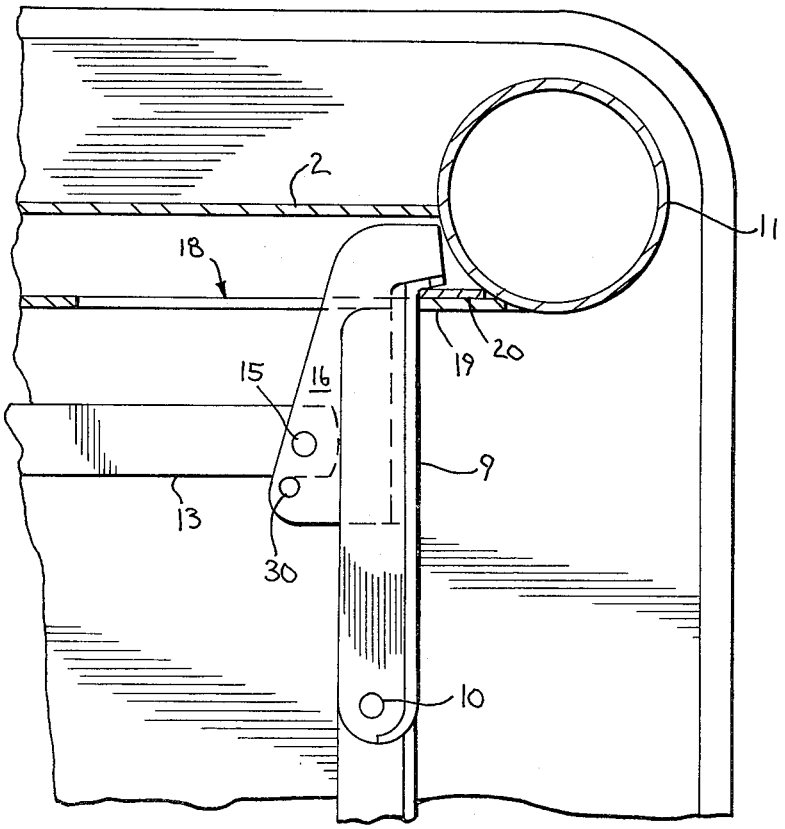
FIG. 4
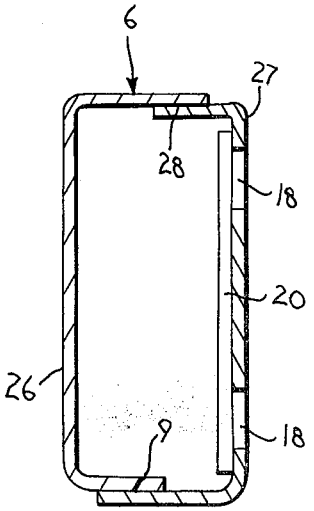
FIG. 5

TABLE WITH FOLDING LEGS

BACKGROUND

This invention relates to a table with folding legs which is steady and permits the folding of the legs by means of a new and improved positively operating mechanism which occupies a minimum amount of space and contains a relatively small number of operating parts.

Tables with folding legs are well known and many patents have been issued describing such tables as, for example, U.S. Pat. Nos. 3,093,095; 3,245,364; 3,554,141; 3,662,694; 3,945,328; 3,991,687 and 3,993,005.

As will be seen from the disclosures of the foregoing patents, many attempts have been made to solve the problems of making tables with folding legs which are not wobbly and which can be assembled easily and dissembled easily without pinching the fingers of the user and without the use of special tools.

BRIEF SUMMARY OF THE INVENTION

In accordance with the invention, a table with folding legs is provided in which the legs are hingedly connected through leg spans to the underside of the top which also contains a pair of opposing aprons extending downwardly and affixed to the underside of the top, said aprons extending longitudinally at right angles to but spaced at their ends from the leg spans, and spreader members hingedly connected at one end to an opposite end of said aprons and slidingly connected at the other end to the leg spans so that the spreader members move inwardly when the leg spans are folded and outwardly in alignment with their respective aprons when the legs are upright and the leg spans are perpendicular to the underside of the table top. Means for locking the spreader members in place when the table is erected are also provided.

DETAILED DESCRIPTION OF THE INVENTION

In the drawings:

FIG. 1 is a perspective view of a table embodying the invention which has been erected;

FIG. 4 is a partial sectional view, with parts broken away, taken transversely of one of the legs on the underside of the table showing the manner in which the spreader and locking mechanism functions, and FIG. 5 is a cross sectional view taken vertically through one of the leg spans.

Figure 2:
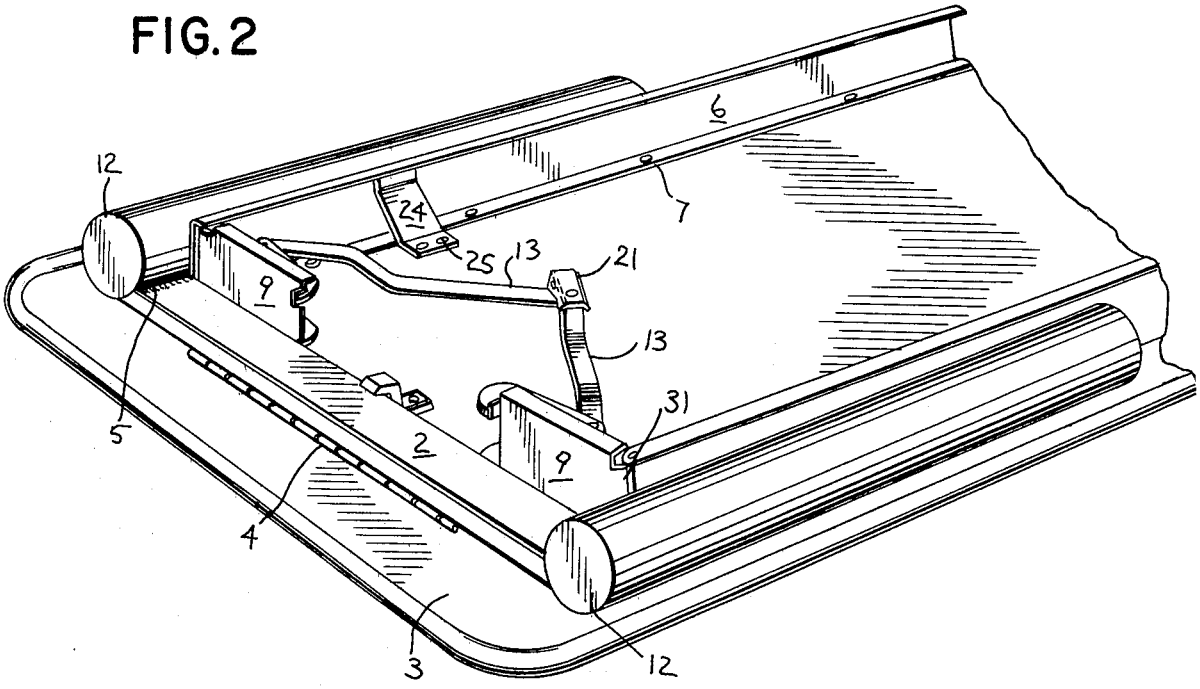
FIG. 2 is a perspective view with parts broken away, of the underside of a portion of the table shown in FIG. 1 with the legs folded.

Referring to the foregoing drawings, the table as shown in FIG. 1 has a top 1, a pair of leg spans 2 connected to the underside 3 of the table top 1 by means of hinges 4 (see FIG. 2), each leg span being fixedly connected by welding it, or by other suitable means, to the upper portion of the legs as generally indicated at 5. A pair of aprons 6 extend downwardly from and are fixed to the underside of the top by any suitable means such as screws 7. These aprons extend longitudinally at right angles to but are spaced at their ends from the leg spans 2, the spacing being illustrated at 8 in FIG. 3.

Spreader members 9 are hingedly connected at 10 to an end of the aprons 6. Each of the spreader members 9 is adapted to move from an inward position as shown in FIG. 2 to an outer position as shown by the dot-dash lines in FIG. 3 and also as shown in full lines in FIG. 1, so that each spreader member fills its respective space 8 and when moved to its outer position is in alignment with the respective aprons 6.

Each of the legs 11 is protected by a cap 12 so that the hand of the user cannot be injured by accidentally contacting the upper end of the legs during assembly. The legs themselves are preferably tubular and are preferably made of aluminum, steel or other rigid durable metal or other material. However, they can also be made of wood and can be solid rather than tubular.

Figure 3:
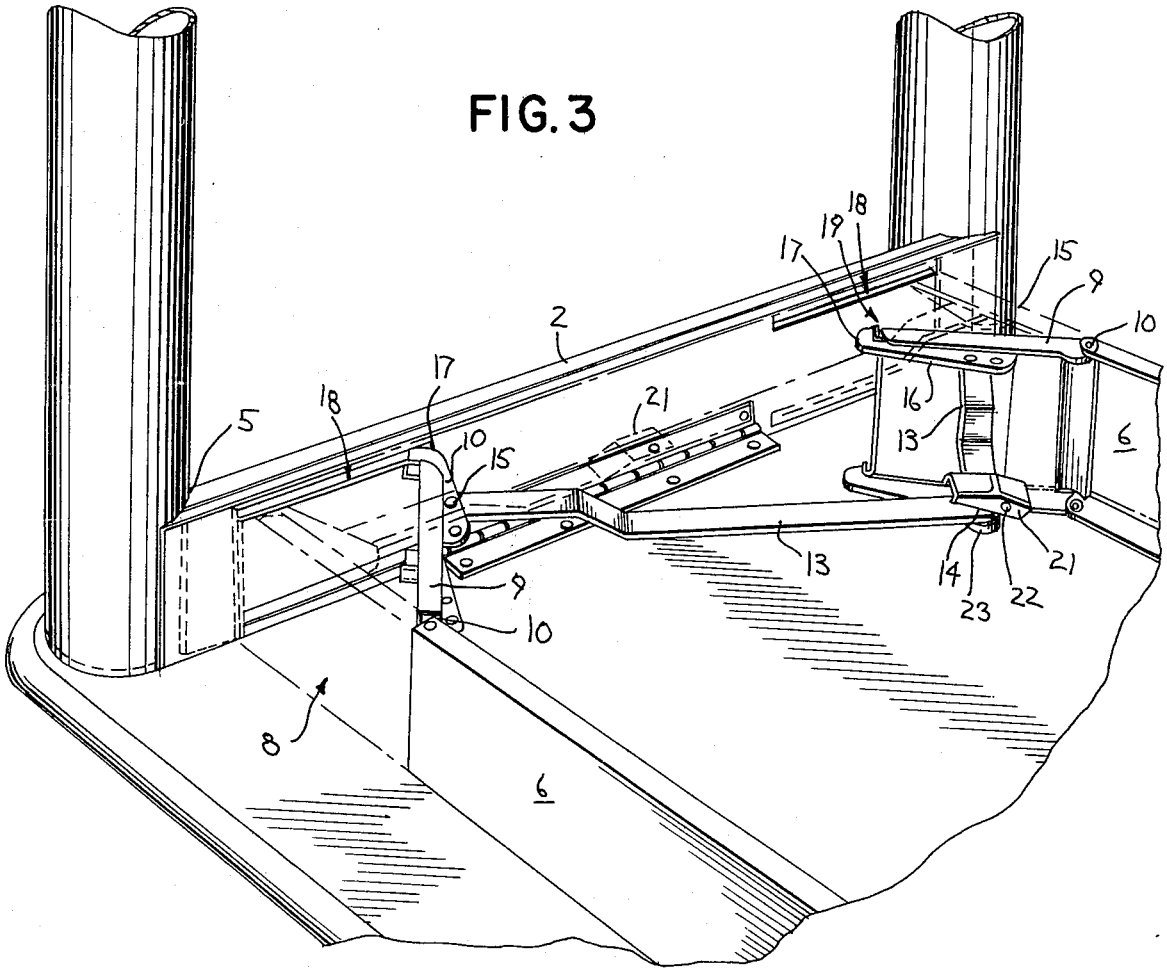
FIG. 3 is a perspective view, with parts broken away, of the underside of a portion of the table shown in FIG. 1 with two of the legs erected just prior to the actuation of spreader members to lock them in place.

When the table is ready to be assembled, it is placed with the top side down and the underside up in the position shown in FIG. 2. The legs are then erected to a perpendicular position with respect to the underside 3 of the top by pulling them up around the hinged connection 4. In this position the appearance will be that shown in FIG. 3.

The spreader members 9 are then moved outwardly by means of lateral braces 13 which are substantially equal in length and are pivotally connected at one end 14 by means of a rivet or in any other suitable manner. Braces 13 are also pivotally connected at 15 to the latch members 16 which in turn are affixed to the insides of spreader members 9. The latch members 16 have outer portions 17 that are adapted to be inserted in to and slide in the slots 18. Latch members 16 also have a hook-like portion 19 so that when the legs are erected and locked into place, the hook-like portion 19 will engage reinforcing plate 20 as shown in FIG. 4. At this point the lateral braces 13 are approximately parallel to leg span 2 and are locked into this position by locking member 21 which is pivotally supported at 22 and spring pressed by means of a coil spring or other suitable resilient means 23. The locking member 21 thereby assumes the position shown in dotted lines in FIG. 3.

The aprons 6 are preferably channel members, although this is not essential and they are preferably reinforced by braces 24 which may be welded to the aprons 6 and secured by means of screws or other suitable means 25 to the underside 3 of the table top 1.

An important feature of the invention resides in the structure of the leg aprons 6 as shown in FIG. 5 wherein two U-shaped channel members 26 and 27 are welded or otherwise secured together at 28 and 29. The inner member is provided with slots 18 to receive the ends 17 of the latch members 16 and a reinforcing plate 20 is welded on the inside of the inner member to receive the hook-like portion 19 of the latch. The leg portion 6 can be relatively small, for example, not more than $2\frac{1}{2}$ inches in height.

Stacking density of stacked tables is directly related to the diameter of the table leg. A $2\frac{1}{2}$ inch diameter leg requires a $2\frac{1}{2}$ inch apron with little or no lateral movement. In other words, the upper horizontal cross sections of the erected legs are approximately the same as the height of the adjoining aprons and the vertical cross sections of the folded legs do not exceed the height of the adjoining aprons. Other stacking tables with folding legs require a 4" to 5" apron due to mechanics and lateral brace requirements.

A projecting portion 30 on latch member 16 acts as a stop for leg braces 13 and assists in the operation of the mechanism.

From the foregoing description it will be apparent that the table is readily assembled and dissembled. In order to prevent pinching of the fingers due to sharp edges, the area 31 on the spreader members 9 is curved.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. A table with folding legs comprising (a) a top, (b) a pair of leg spans hingedly connected to the underside of said top, each leg span forming an apron at opposite ends of the table, each leg span being fixedly connected at its end to a leg, the legs and leg span being so constructed and hinged that opposite pairs of legs fold toward one another and when folded lie along the underside of the top, (c) a pair of opposing side aprons extending downwardly from and fixed to the underside of said top, said aprons extending longitudinally at right angles to but spaced to provide space between their ends and said leg spans of (b), (d) means comprising spreader members mounted in said spaces of (c) each hingedly connected at one end to an end of one of said side aprons and connectable at the opposite end to one of the leg spans of (b) by a sliding connection whereby said spreader members are movable inwardly when said pair of leg spans and said legs are folded and are movable outwardly in alignment with their respective aprons so as to form a continuation of said side aprons when said legs are upright and said leg spans are perpendicular to the underside of the table top, and (e) means for locking said spreader members in place when said table is erected, and said locking means comprising hook-shaped members fixed to and extending outwardly from the end of said spreader member of (d) opposite said ends hingedly connected to said aprons, said hook-shaped members engaging ends of slots in said leg spans and partially enclosing the outer ends of said slots when said spreader members of (d) are moved outwardly in alignment with their respective aprons.

2. A table as claimed in claim 1 in which said leg spans of (b) are hollow members formed by generally U-shaped channel members disposed so as to enclose the opening of the U between them with one said U-shaped member on the outside and the other on the inside of said table, the inside members containing said slots.

3. A table as claimed in claim 2 in which said hollow members have a reinforcing plate within said inside channel member adjacent the outer ends of said slots to receive said hook-shaped members.

4. A table as claimed in claim 2 in which said spreader members are pivotally connected to lateral braces which are pivotally connected to each other so as to be in alignment with one another when said table is erected, and means comprising a clasp to hold said lateral braces in alignment and lock the legs in place when the table is erected.

5. A table as claimed in claim 1 in which the upper horizontal cross sections of the erected legs are approximately the same as the height of the adjoining aprons and the vertical cross sections of the folded legs do not exceed the height of the adjoining aprons.

6. A table as claimed in claim 1 in which the upper horizontal cross sections of the erected legs are approximately the same as the height of the adjoining aprons and the vertical cross sections of the folded legs do not exceed the height of the adjoining aprons, and the upper horizontal cross section of the erected legs and the height of the adjoining aprons do not exceed $2\frac{1}{2}$ inches.

7. A table as claimed in claim 1 in which the dimensions of said table top, said side aprons, and said leg spans are such that said legs in the folded position are outside of said side aprons and what is normally the outer sides of said spreader members is positioned against what is normally the underside of said leg spans when the legs are upright.

* * * * *